United States Patent [19]

Heyn

[11] 4,318,494

[45] Mar. 9, 1982

[54] EASY OPENING CONTAINER WITH VENT MEANS

[75] Inventor: William M. Heyn, New Canaan, Conn.

[73] Assignee: The Continental Group, Inc., New York, N.Y.

[21] Appl. No.: 191,224

[22] Filed: Sep. 26, 1980

[51] Int. Cl.[3] ..... B65D 17/34; B65D 51/16

[52] U.S. Cl. ..... 220/271; 220/366

[58] Field of Search ..... 220/269, 270, 271, 359, 220/67, 366

[56] References Cited

U.S. PATENT DOCUMENTS

| | | | |
|---|---|---|---|
| 3,286,875 | 11/1966 | Frankenberg | 220/270 |
| 3,701,454 | 10/1972 | Thorp | 220/270 |
| 3,820,681 | 6/1974 | Hulse | 220/270 |
| 4,157,764 | 6/1979 | Moller | 220/271 X |

*Primary Examiner*—George T. Hall

*Attorney, Agent, or Firm*—Charles E. Brown

[57] ABSTRACT

A lightweight container of thin metal such as aluminum which is subject to collapse when load is exerted thereagainst wherein the closure and container are made to minimize the application of such load, the container having a pouring neck and the closure having a panel with a groove into which the neck is telescoped and adhesively bonded thereto, the closure being openable by exerting tensile forces thereon for breeching a selected area of the securement of the closure panel to the neck and then fracturing a push-in section of the panel and whereupon minimal forces are required to open the container without imposing undesirable loads thereagainst. The closure also is tamperproof and vents prior to opening.

8 Claims, 5 Drawing Figures

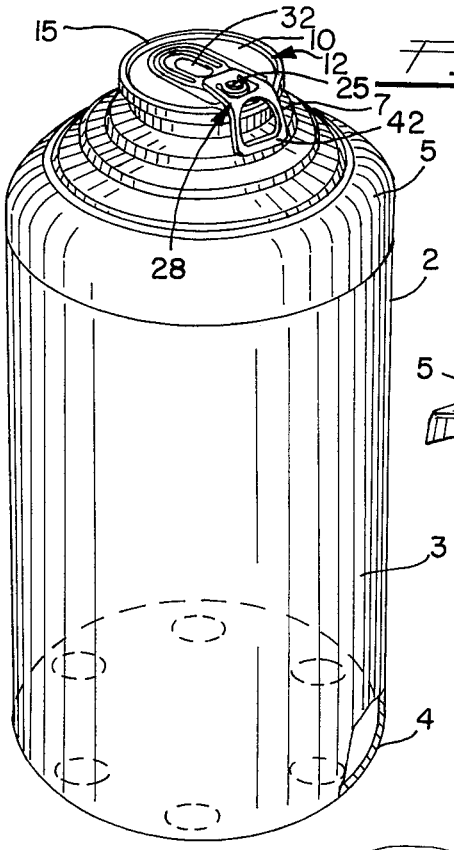
FIG. 1
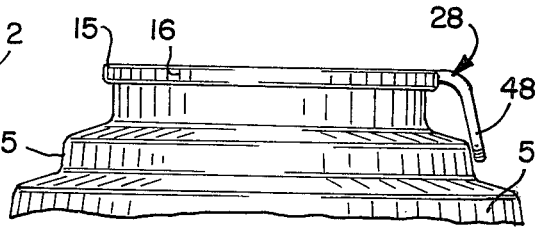
FIG. 3
FIG. 2
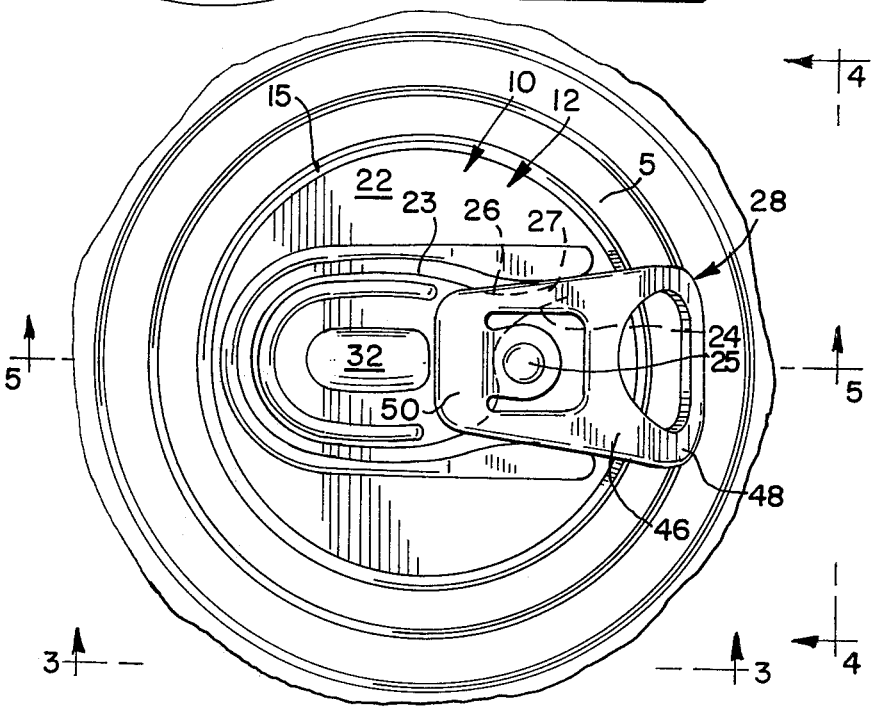

FIG. 4
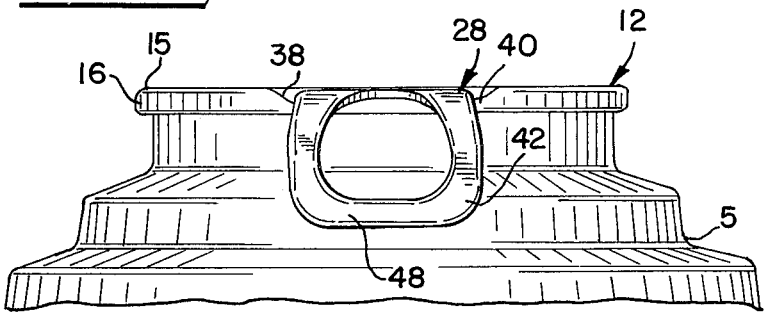
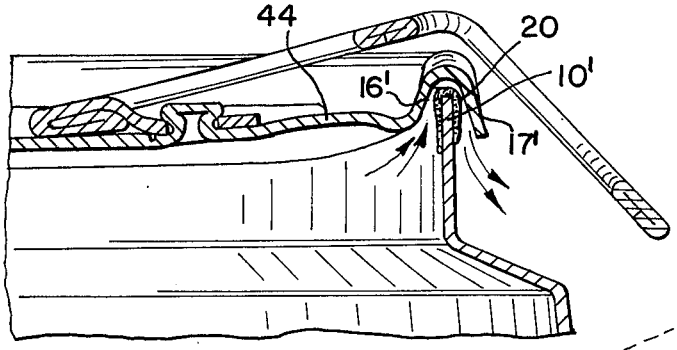
FIG. 6
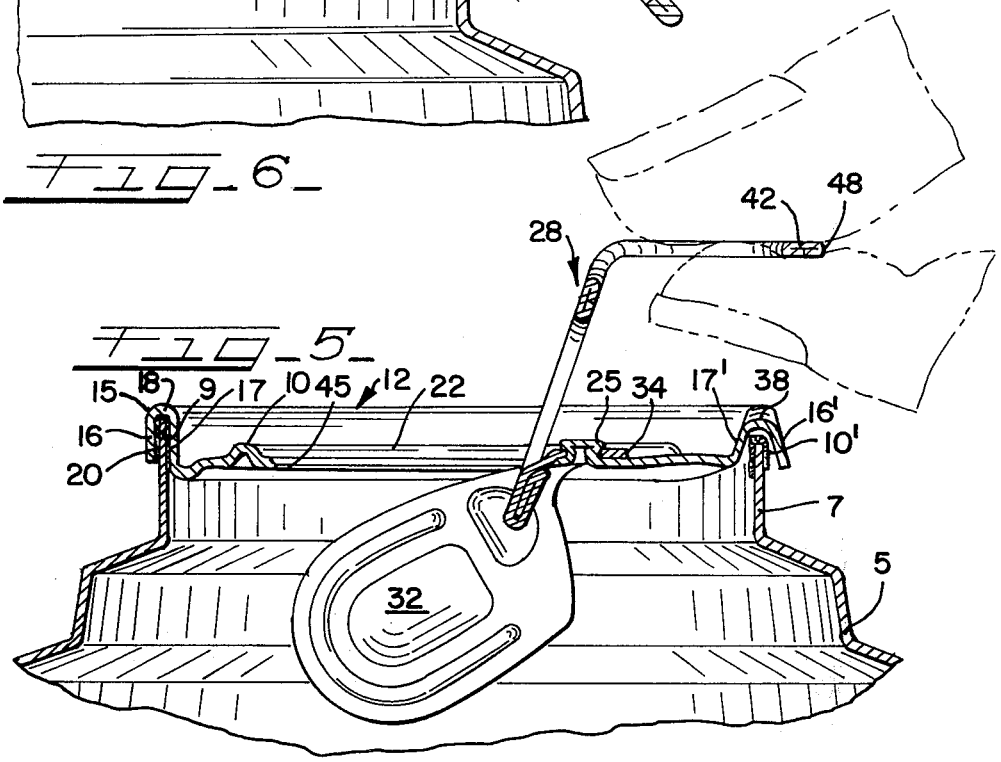
FIG. 5

EASY OPENING CONTAINER WITH VENT MEANS

BACKGROUND OF THE INVENTION

This invention pertains to containers which are made of thin sheet metal such as aluminum less than 10 mils thick and which comprise a top dome-like portion which tapers to a small pour opening. Various closures have been made for the opening, most of which are plastic and require that they be inserted into the opening with a tight fit. This requires that the dome section must be constructed in such a way as to resist the axial loads imposed during insertion of the closure or complex support mechanisms must be provided to prevent axial collapse of the top during assembly with the closure.

DISCUSSION OF THE PROBLEM

Because of the thin section of the metal of the container, it is necessary to provide a closure which can be opened without rupturing the container, but which will sustain the pressures imposed thereon of between 90–140 pounds per square inch. The closure must also be easily fabricated, preferably with existing technology and machinery to minimize capital investment. It must also be unobtrusive and its operation easily perceived. Furthermore, it must be pilferproof so that once the container is opened, it cannot be reclosed without apparent evidence of tampering.

SOLUTION OF THE PROBLEM

This invention offers a pilferproof closure which may be manufactured with existing equipment and which may be secured to the container preferably by adhesives to the neck of the container.

The invention comprehends forming a closure having a panel with a score which defines a tear section which is openable by a lever tab secured to the panel outside the tear section, the tab having a nose portion overlying the tear section, and a handle portion which extends through a depressed or notched peripheral portion of the panel. The handle or lift portion is unobtrusively angled below the closure generally parallel with the conical or dome section of the top of the container.

The invention contemplates rearranging the tab and its connection to the closure panel in the vicinity of the notched area of the periphery of the end panel so that upon lifting of the handle of the tab, the lever presses with its nose portion on the tear section and initially lifts the section of the panel adjacent to the notched region with a second class lever action. This causes the notched region to deform and to break the adhesive joining it with the upper edge of the can body, thus venting the container. Thereafter continued upward lifting of the tab breaks the score and presses the tear out portion into the container.

The arrangement is such that once the seal is broken by lifting the tab, the end panel in the notched region is so deformed that the handle cannot be returned to its original position thus indicating tampering.

The invention discloses a tab depressed below the rim of the closure panel so as not to obtrude and thus will not hinder can stacking.

These and other objects and advantages inherent in and encompassed by the invention will become more apparent in the specification and the drawings wherein:

FIG. 1 is a perspective view of a container incorporating my novel closure;

FIG. 2 is an enlarged fragmentary top plan view thereof;

FIG. 3 is a fragmentary side elevational view of the upper portion of the container taken substantially on line 3—3 of FIG. 2;

FIG. 4 is a view similar to FIG. 3 but is taken from the handle end of the closure, generally on line 4—4 of FIG. 2;

FIG. 5 is a cross-sectional view taken on line 5—5 of FIG. 2 showing the closure in open position.

DESCRIPTION OF THE INVENTION

The invention is disclosed in connection with a thin, preferably aluminum, container having a wall thickness of between 4–7 mils, all made preferably of H-19-3004 materials.

The container 2 comprises a lower portion having a cylindrical body 3 with an integral bottom 4 and a toroconical upper portion 5 which is telescoped over the upper end of the body portion and bonded thereto by a suitable, preferably thermoplastic adhesive, although any other adhesive may be used. The top portion which is between 4–7 mils thick has an upwardly extending cylindrical neck 7 which fits into a peripheral groove 9 in an end panel 10 of a closure generally designated 12.

The end panel is made of H-19-3004 aluminum and has an annular peripheral bead 15 including an outer flange 16 and an inner flange 17 and a bridging top wall section 18 which defines the beforementioned groove 9.

An adhesive 20 is located on the interior and exterior sides of the neck 10' and the opposing sides of the flanges 16 and 17 bonding the closure to the neck portion.

The closure has a central panel section 22 in which there is provided a U-shaped score 23 which has one leg 24 looped in front of the rivet 25 and terminates at one side of the rivet. The other end of the score is continued in spaced relation to leg 24 as a leg 26 which forms a hinge 27 therewith as well known in art and disclosed in U.S. Patent Application Ser. No. 83,450 filed Oct. 10, 1979 for Easy Opening Container with Non-Detach Tab in the name of Gary K. Hasegawa.

A tab or lever 28 has a nose portion 30 overlying a tear out section 32 defined by the score line 23. The tab has an attachment lug 34 which is secured by the integral rivet 25 formed on the central panel section 22 adjacent a notched section 38 in the neck 10 into which a depressed segment 40 of the peripheral portion of the end panel is fitted. It will be noted that the flanges 16 and 17 immediately below the segment 40 are of lesser depth than the remaining portions of the flanges 16 and 17 and that these short sections 16' and 17' are also connected to the shortened neck section 10' by adhesives. This structure, that is, the notched neck section and shortened flange connections and the depression of the segment 40 are purposely so formed adjacent to the rivet connection of the tab so as to rupture initially upon lifting of the handle 42 of the tab as seen in FIG. 5. Lifting of the tab lifts the rivet which causes the section 44 between the rivet and the peripheral flange 16 to unfold the material pulling flange portion 16 away from the neck section 10. This ruptures the adhesives and vents the container. At about the same time, or immediately thereafter, the score in front of the rivet ruptures the score which propagates entirely around the nose presses the tear section into the container, thus forming a pour opening 45 (FIG. 5).

The inner end portion 46 of the handle in the closed position of the closure (FIGS. 1–4) fits into the slot or depression formed in segment 40 and the outer end portion 48 is bent downwardly in radially outwardly spaced relation to the neck 10 so that it may be easily grasped and manipulated.

After opening the closure, the handle is returned to a down position if the customer wishes to drink the contents directly from the can.

Having described a preferred embodiment of the invention, it will be understood that variations thereof will be apparent which come within the scope of the claims.

I claim:

1. A closure for a container for pressurized contents comprising a body having a bottom at one end and an end member at the other end, means securing said end member to said body, a score in said end member defining a tear out panel portion, a tab secured to said end member having a nose overlying said panel portion, means securing said tab to said end member outside tear out panel portion, said tab and means securing said tab formed and arranged to rupture said means securing said end member to said body pursuant to lifting of the tab for venting the container, and said tab operative thereafter to rupture the score and push said tear out panel portion into the container.

2. The invention according to claim 1 and said end member having a peripheral raised portion of U-shape in cross-section defining a groove receiving a portion of said body therein and said means securing the end member to the body comprising an adhesive.

3. The invention according to claim 2 and said raised portion having a depression therein and said tab extending through said depression below the upper edge of said end member.

4. The invention according to claim 3 and said U-shaped peripheral portion and body portion at said depression having relatively short overlapping portions facilitating separation thereof upon lifting of the tab.

5. The invention according to claim 1 and said tab extending beyond the periphery of the end member and having a handle portion angled alongside said body portion.

6. The invention according to claim 5 and said container being made of thin sheet metal of less than 7 mils in thickness and said closure operative to stress said container in tension during the initial opening of said closure.

7. The invention according to claim 6 and said closure having portions embracing said body and said tab being disposed to initially peel away a portion of said closure from the body to rupture the means securing said end member to said body.

8. A lightweight container made of sheet aluminum comprising a body with an integral bottom and a generally conically shaped top having a neck forming a relatively small pour opening, a closure for the opening having a panel with a portion telescoped within said neck, means adhesively securing the neck to said panel portion, means providing a weakened area in said securement of the panel to the neck, said panel having a score therein defining a tear out portion and a tab secured to said panel for rupturing said weakened area and then said score for opening the container.

* * * * *